US006186158B1

(12) United States Patent
Goarin

(10) Patent No.: US 6,186,158 B1
(45) Date of Patent: Feb. 13, 2001

(54) AIR CONDITIONER SHELTER

(76) Inventor: Guy Goarin, 932 River Hills Dr., San Marcos, TX (US) 78666

( * ) Notice: Under 35 U.S.C. 154(b), the term of this patent shall be extended for 0 days.

(21) Appl. No.: 09/358,466

(22) Filed: Jul. 22, 1999

(51) Int. Cl.[7] ..... E04H 15/36
(52) U.S. Cl. ..... 135/128
(58) Field of Search ..... 135/128, 121; 52/3

(56) References Cited

U.S. PATENT DOCUMENTS

| | | | | |
|---|---|---|---|---|
| 2,967,533 | | 1/1961 | Ballinger . | |
| 2,989,967 | | 6/1961 | Lee . | |
| 3,744,500 | | 7/1973 | Briggs . | |
| 3,908,393 | * | 9/1975 | Eubank | 62/305 |
| 4,926,892 | | 5/1990 | Osmonson et al. . | |
| 5,097,678 | * | 3/1992 | Aubuchon | 62/506 |
| 5,622,198 | | 4/1997 | Elsinger . | |
| 5,655,382 | * | 8/1997 | Chen | 62/262 |

* cited by examiner

*Primary Examiner*—Alvin Chin-Shue
*Assistant Examiner*—Sarah Purol
(74) *Attorney, Agent, or Firm*—Siemens Patent Services, LC

(57) ABSTRACT

A shelter for the condenser of an air conditioning system. The shelter comprises four lateral wall panels and a covering panel which are joined together to form a parallelepiped covering the condenser on all sides except the bottom where the condenser rests on the ground. The panels have rigid peripheral structural frame channels and mesh material supported on the frame channels. The mesh material passes air and obstructs leaves and similar debris which would otherwise clog the condenser. The shelter is assembled by threaded fasteners which are threaded into holes formed in the frame channels of the various panels. One lateral panel has a relief opening enabling the assembled shelter to be lowered over the condenser without causing interference with refrigerant conduits and power and control cables.

5 Claims, 3 Drawing Sheets

AIR CONDITIONER SHELTER

BACKGROUND OF THE INVENTION

1. Field of the Invention

The present invention relates to permanent air conditioners, and more particularly to apparatus for protecting an exposed permanent air conditioner component from external contamination. The apparatus comprises a readily erected shelter which surrounds and covers the air conditioner component at all sides except that resting on the ground. The contemplated application of the invention is the condensing unit of a split system air conditioner for residential, commercial, institutional, agricultural, and industrial buildings.

2. Description of the Prior Art

When buildings are to be artificially heated cooled by air conditioners and heat pumps, a heat exchange component of the system is usually located outdoors near or on the building. In air conditioners, the heat exchange component is a condensing coil usually accompanied by a refrigeration compressor. In heat pumps, the function of the outdoor heat exchanger is that of absorbing ambient heat, although the apparatus is similar to that for air conditioners.

Regardless of whether the function is that of dissipating or collecting heat, the apparatus typically includes a working medium-to-air heat exchanger, which will hereinafter be termed the condenser for convenience. The condenser usually has a fan for forcing ambient air across the coils and fins, or corresponding heat exchange structure. In operation, air is continuously passed across the coils and fins. Operation may be obstructed should foreign matter become entrapped on or in the coils and fins, thereby reducing air flow.

In many applications, such occurrence is frequently encountered. In residential yards, leaves, grass, plant clippings, loose leaves, twigs, insects and pests, and other contaminants abound, and threaten proper operation of the air conditioner or heat pump. The usual response of those charged with maintenance of the air conditioner or heat pump system is to periodically clean the exposed component. The prior art has not proposed shelters specifically adapted for condensers, although such shelters are known for other applications.

An example is seen in U.S. Pat. No. 2,967,533, issued to Virgil R. Ballinger on Jan. 10, 1961, which illustrates a five sided, screened enclosure. The device of Ballinger lacks a permanent small opening for allowing passage of refrigerant conduits and control cables, and is not associated with an air conditioning or heat pump condenser. Also, the peripheral frame members are not described as being entirely angle channel joined by screws.

Other examples are seen in U.S. Pat. No. 2,989,967, issued to Kenneth D. Lee on Jun. 27, 1961, U.S. Pat. No. 3,744,500, issued to Robert S. Briggs on Jul. 10, 1973, U.S. Pat. No. 4,926,892, issued to Daniel T. Osmonson et al. on May 22, 1990, and U.S. Pat. No. 5,622,198, issued to Raymond A. Elsinger on Apr. 22, 1997. Each of the subjected devices of these patents differs from the present invention in the manner of Ballinger.

None of the above inventions and patents, taken either singly or in combination, is seen to describe the instant invention as claimed.

SUMMARY OF THE INVENTION

The present invention provides a readily erected, portable shelter suitable for covering and protecting the outdoor condenser of a split system air conditioner or heat pump. The shelter comprises five rectangular panels which are joined to one another to form a parallelepiped covering the condenser. One panel has a relief which passes refrigerant conduits and control and power electrical cables. The relief opening is located proximate the ground, and opens downwardly so that the panel including the relief opening, and also the assembled shelter, may be lowered over the condenser and set into a final position without causing interference between the conduits and the shelter.

Each panel of the shelter is of mesh construction, so that air flows readily to the condenser, but leaves, trash, and other debris are excluded from access to the condenser. To a certain degree, the condenser is protected from weather and sun. And to the extent that contact with the condenser could be dangerous to children and pets, the shelter protects children and pets from the condenser.

Benefits to the condenser include reduced cleaning and maintenance. Also, operating temperature is reduced due to the cooling effect of air flow, which reduces energy consumption and extends the useful life of the compressor serving the air conditioner or heat pump.

The shelter further improves aesthetics of the condenser by partially concealing the same.

Accordingly, it is one object of the invention to provide a protective shelter for excluding leaves and other debris from the condenser of an air conditioning system.

It is another object of the invention that the shelter be readily erected.

It is a further object of the invention to improve efficiency and life expectancy of components of the air conditioning system.

Still another object of the invention is to protect animals and children from incidental contact with the condenser.

An additional object of the invention is to improve aesthetics of the condenser.

Yet another object of the invention is to enable the shelter to be lowered into place over the condenser while avoiding interference with refrigerant conduits and electrical cables serving the condenser.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
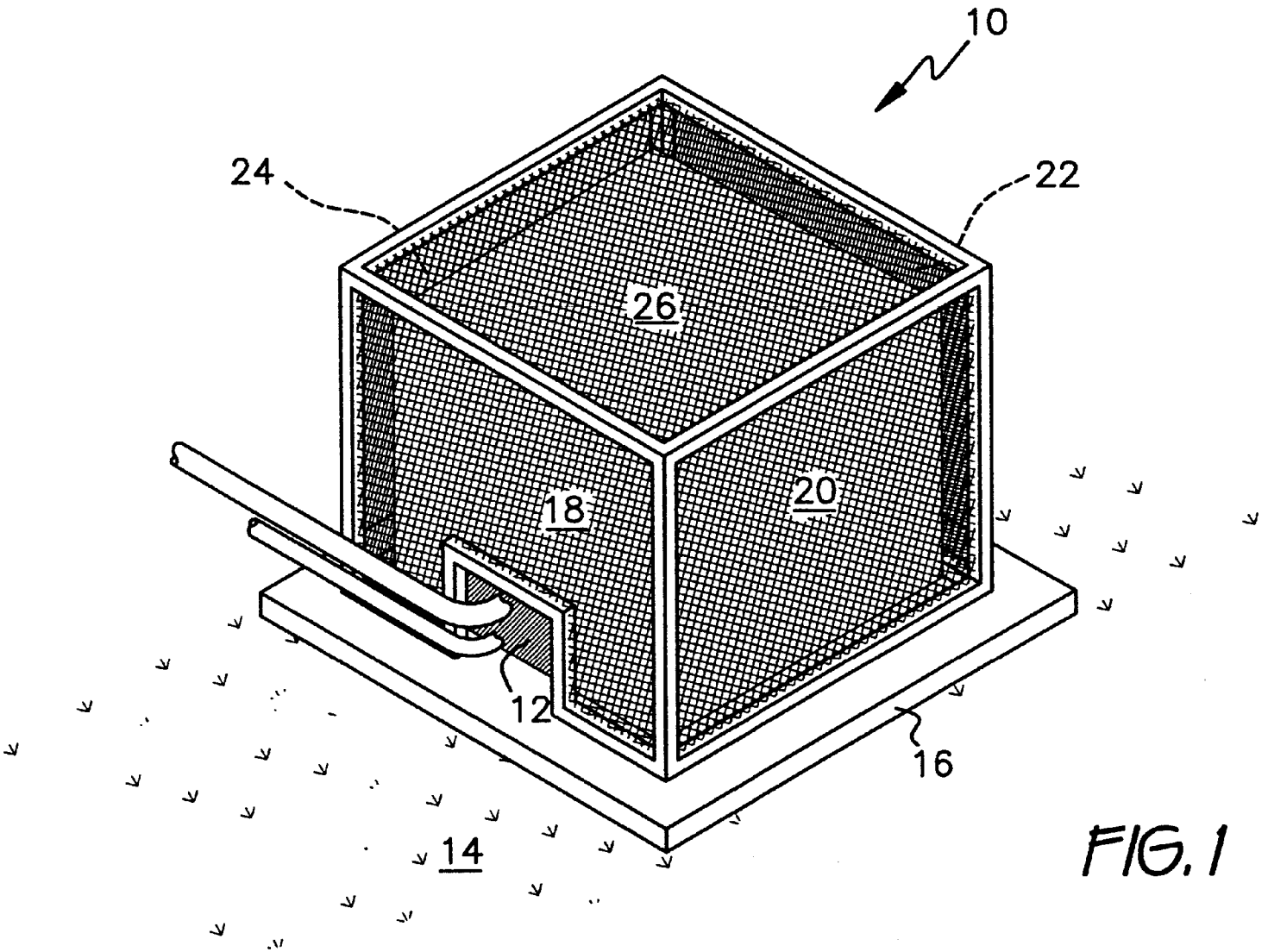
FIG. 1 is an environmental, perspective view of the invention.

FIG. 1 of the drawings shows novel shelter 10 covering and protecting a condenser 12 of an air conditioning or heat pump system (not shown in their entirety). Condenser 12 ultimately rests on the ground 14, although according to conventional practice, condenser 12 is placed on a concrete pad 16. Shelter 10 comprises a plurality of lateral wall panels 18, 20, 22, 24 and a covering panel 26. When assembled together, wall panels 18, 20, 22, 24 and covering panel 26 generally form a parallelepiped (albeit open at the bottom) surrounding and covering condenser 12 at the lateral sides and at the top. Panels 18, 20, 22, 24 cover condenser 12 and close condenser 12 to unobstructed lateral access. Similarly, covering panel 26 covers condenser 12 from the top and preclude direct access from above.

Figure 2:
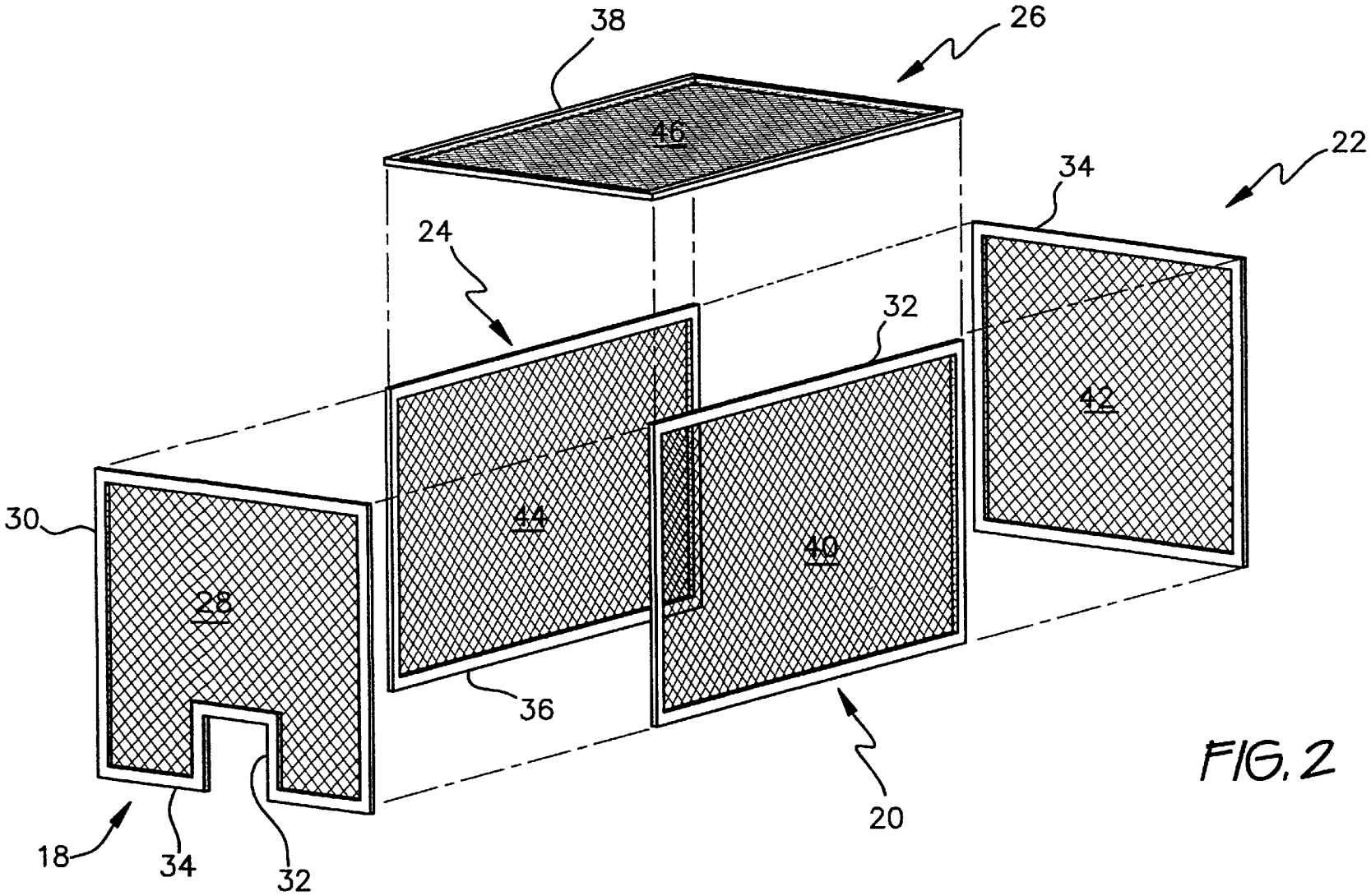
FIG. 2 is an exploded detail view of the novel shelter.

As clearly seen in FIG. 2, lateral wall panel 18 has a mesh center 28 enabling air to pass through panel 18. Mesh is understood to include interwoven fabric, wire meshed materials, expanded metal, perforated solid sheet of any suitable material, or any other suitable strong material having interstitial spaces capable of passing air to condenser 12. Mesh center 28 is fixed to and supported on a rigid peripheral structural frame channel 30 extending along the entire periphery of panel 18. Lateral wall panels 20, 22, 24 and covering panel 26 also have respective peripheral structural frame channels 32, 34, 36, 38 and respective mesh centers 40, 42, 44, 46.

Panel 18 differs from the others in having a relief, opening 32. Relief opening 32 opens downwardly, being disposed in relation to bottom edge 34 of panel 18 such that interference with conduits and cables 36 (see FIG. 1) projecting laterally from condenser 12 is avoided when shelter 10 is lowered over condenser 12 to the point that shelter 10 contacts concrete pad 16 (or ground 14).

Figure 3:
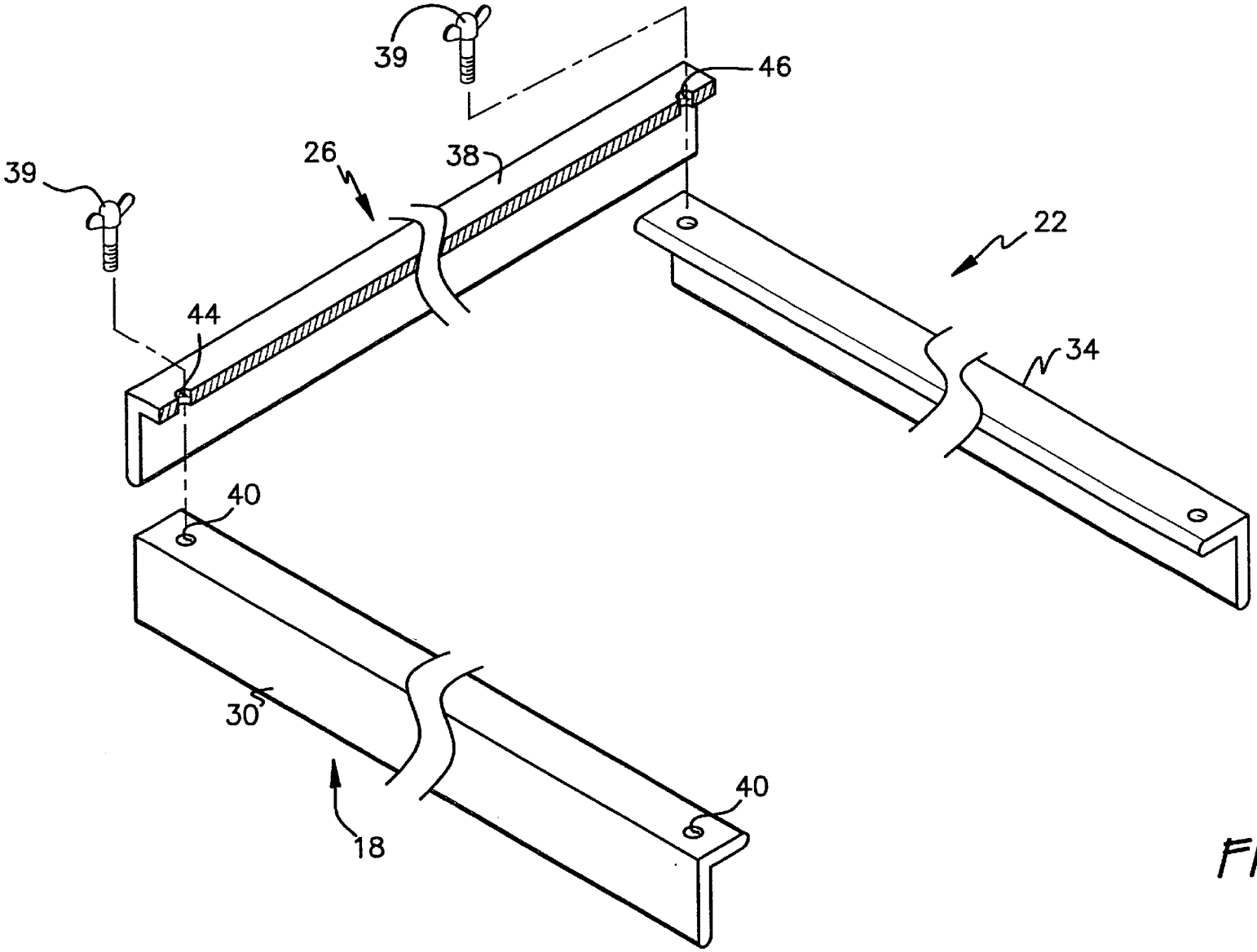
FIG. 3 is a side elevational detail view of the novel shelter, shown partially in cross section.

Referring now to FIG. 3, shelter 10 is assembled by threaded fasteners 39 with covering panel 26 secured to lateral wall panels 18, 20, 22, 24. Frame channels 30, 34 have respective threaded first holes 40, 42 which are alignable with unthreaded second holes 44, 46 of frame channel 38 of covering panel 26. When aligned, fasteners 39 secure frame channel 38 of covering panel 26 to frame channels 30, 34 of lateral wall panels 18, 22 in their operative orientation relative to condenser 12, as shown in FIG. 1.

Panel 26 can be attached to all lateral wall panels 18, 20, 22, 24, or to fewer if desired. It is preferable to attach panel 26 to two opposed lateral wall panels 18, 22 or 20, 24 for stability of the assembled shelter 10. Additional fastener holes 48 are provided for securing panels 20, 24 to panels 18, 22.

Fasteners 39 are manual in that they are grasped by hand, or alternatively are driven by hand tools (not shown) such as socket wrenches, screw drivers, and other ordinary hand tools.

The invention may be considered to include condenser 12, where shelter 10 is dimensioned and configured to cooperate closely with condenser 12. It is preferred that shelter 10 be about one half inch (1–2 cm) greater in length and depth than is condenser 12, and six inches (15 cm) higher than is condenser 12, for condensers typical of residential and commercial split systems.

It is to be understood that the present invention is not limited to the embodiments described above, but encompasses any and all embodiments within the scope of the following claims.

I claim:

1. A shelter for a condenser of an air conditioning system, wherein the condenser rests on the ground, said shelter comprising:

a plurality of lateral wall panels each having a mesh center enabling air to pass therethrough, wherein each said lateral wall panel has means for removably and manually attaching to adjacent said lateral wall panels such that said lateral wall panels cover the condenser and close the condenser to unobstructed lateral access; and a covering panel having a mesh center enabling air to pass therethrough and means for removably and manually attaching to at least two of said lateral wall panels such that said covering panel covers the condenser and closes the condenser to unobstructed access from above, wherein one said lateral wall panel has a bottom edge and a relief opening formed in said one lateral wall panel, said relief opening disposed in relation to said bottom edge such that interference with conduits and cables projecting laterally from the condenser is avoided when said shelter is lowered over the condenser to the point that said shelter contacts the ground.

2. The shelter according to claim 1, wherein each said lateral wall panel includes a rigid peripheral structural frame channel extending along the entire periphery of said lateral wall panel, and said covering panel has a rigid peripheral structural frame channel extending along the entire periphery of said covering panel.

3. The shelter according to claim 2, wherein said frame channels of said lateral wall panels have first holes, said frame channel of covering panel has second holes alignable with said first holes, wherein said first holes and said second holes accept threaded fasteners such that said lateral wall panels are secured to said covering panel in operative orientation.

4. The shelter according to claim 1, further comprising a condenser of an air conditioning system, wherein said shelter is dimensioned and configured to surround and cover said condenser on all lateral sides and at the top of said condenser.

5. In combination, a condenser of an air conditioning system wherein the condenser rests on the ground and an associated shelter covering said condenser, comprising:

a condenser;

a shelter having a plurality of lateral wall panels each having a mesh center enabling air to pass therethrough, wherein each said lateral wall panel has means for removably and manually attaching to adjacent said lateral wall panels such that said lateral wall panels cover the condenser and close the condenser to unobstructed lateral access, and a rigid peripheral structural frame channel extending along the entire periphery of said lateral wall panel, and said covering panel has a rigid peripheral structural frame channel extending along the entire periphery of said covering panel, wherein said frame channels of said lateral wall panels have first holes, said frame channel of covering panel has second holes alignable with said first holes, wherein said first holes and said second holes accept threaded fasteners such that said lateral wall panels are secured to said covering panel in operative orientation, and a covering panel having a mesh center enabling air to pass therethrough and means for removably and manually attaching to at least two of said lateral wall panels such that said covering panel covers the condenser and closes the condenser to unobstructed access from above, wherein one said lateral wall panel has a bottom edge and a relief opening formed in said one lateral wall panel, said relief opening disposed in relation to said bottom edge such that interference with conduits and cables projecting laterally from the condenser is avoided when said shelter is lowered over the condenser to the point that said shelter contacts the ground, wherein said shelter is dimensioned and configured to surround and cover said condenser on all lateral sides and at the top of said condenser in close cooperation therewith.

* * * * *